US005868588A

United States Patent [19]

Chadbourne et al.

[11] Patent Number: 5,868,588

[45] Date of Patent: Feb. 9, 1999

[54] ELECTRICAL WEDGE CONNECTOR WITH COLLAPSIBLE REAR EXTENSION

[75] Inventors: Richard Chadbourne, Merrimack; Armand T. Montminy, Manchester, both of N.H.

[73] Assignee: Framatome Connectors USA, Inc., Fairfield, Conn.

[21] Appl. No.: 839,195

[22] Filed: Apr. 23, 1997

[51] Int. Cl.[6] ..... H01R 4/50

[52] U.S. Cl. ..... 439/783

[58] Field of Search ..... 439/783, 863

[56] References Cited

U.S. PATENT DOCUMENTS

| | | | |
|---|---|---|---|
| 4,650,273 | 3/1987 | Roosdrop | 339/247 |
| 5,006,081 | 4/1991 | Counsel et al. | 439/783 |
| 5,507,671 | 4/1996 | Chadbourne et al. | 439/783 |
| 5,538,447 | 7/1996 | Chadbourne et al. | 439/783 |
| 5,558,546 | 9/1996 | Chadbourne et al. | 439/783 |
| 5,567,186 | 10/1996 | Diniz et al. | 439/783 |
| 5,613,883 | 3/1997 | Chadbourne et al. | 439/783 |
| 5,679,031 | 10/1997 | Chadbourne et al. | 439/783 |

*Primary Examiner*—Gary Paumen
*Attorney, Agent, or Firm*—Perman & Green, LLP

[57] ABSTRACT

An electrical wedge connector with a sleeve and a one-piece wedge. The wedge has a rearward extension extending at one lateral side. When the wedge is fully inserted into the sleeve, the rear end of the wedge is substantially located inside the sleeve. However, the rearward extension extends past the rear end of the sleeve to provide a grasping surface. The rearward extension is preferably collapsible.

19 Claims, 3 Drawing Sheets

ELECTRICAL WEDGE CONNECTOR WITH COLLAPSIBLE REAR EXTENSION

BACKGROUND OF THE INVENTION

1. Field of the Invention

The present invention relates to electrical connectors and, more particularly, to a wedge connector.

2. Prior Art

U.S. Pat. No. 4,650,273 discloses an electrical connector with a general "C" shaped sleeve and a wedge. The wedge is stamped and formed from sheet metal and has a tab at its front end. The tab engages a front end of the sleeve to resist withdrawal of the wedge from the sleeve. U.S. Pat. No. 5,006,081 discloses a wedge connector with a "C" shaped sleeve having a hole in its middle section for engaging a dimple on a stamped and formed sheet metal wedge.

SUMMARY OF THE INVENTION

In accordance with one embodiment of the present invention an electrical wedge connector is provided comprising a connector sleeve and a wedge. The wedge is a one piece wedge suitably sized and shaped to be inserted into the sleeve. The wedge is comprised of a thin metal member having a rear end with a rearward extension extending at one lateral side. When the wedge is fully inserted into the sleeve the rear end of the wedge is substantially located inside the sleeve and the rearward extension extends past a rear end of the sleeve to provide a grasping surface.

In accordance with another embodiment of the present invention an electrical wedge connector is provided comprising a connector sleeve and a wedge. The wedge is a one piece member suitably sized and shaped to be inserted into the sleeve. The wedge has a general tubular wedge shape with a rear end having a collapsible rearward extension. The extension is adapted to be collapsed for removing the wedge from the sleeve.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
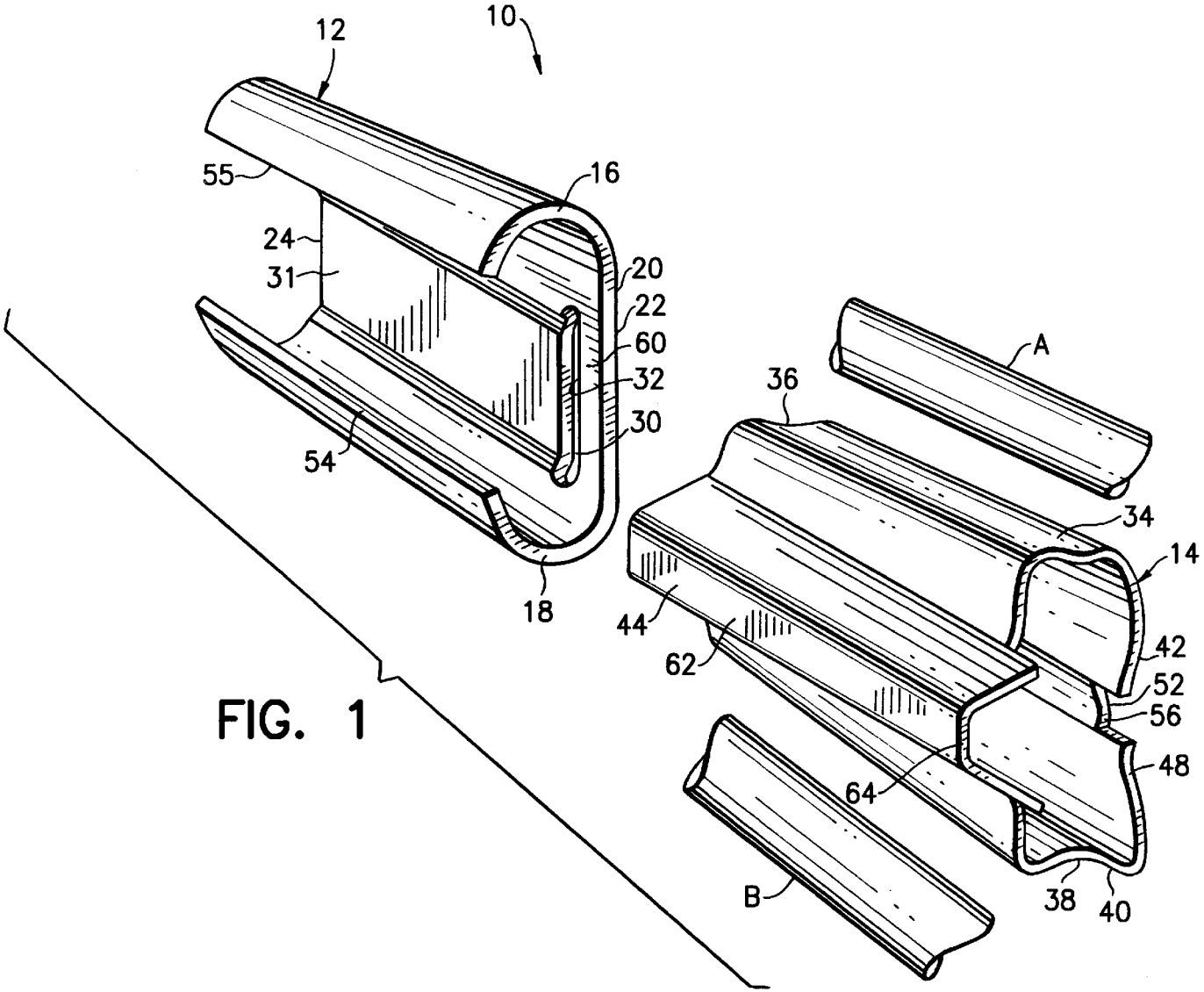
FIG. 1 is an exploded perspective view of a wedge connector incorporating features of the present invention with two conductors.

Referring to FIG. 1, there is shown an exploded perspective view of an electrical wedge connector 10 incorporating features of the present invention for mechanically and electrically connecting two conductors A and B to each other. Although the present invention will be described with reference to the embodiments shown in the drawings, it should be understood that the present invention can be embodied in many alternate forms of embodiments. In addition, any suitable size, shape or type of elements or materials could be used.

The connector 10 generally comprises a connector sleeve or shell 12 and a wedge 14. The sleeve 12 is preferably made of metal, but it could also be made of other materials. The sleeve 12 is preferably made of sheet metal, but it could also be a cast, drawn or deep-drawn, or extruded member. The sleeve 12 has two opposing channel sections 16, 18 interconnected by a middle section 20 to form a general cross-sectional "C" shape. The "C" shape tapers from the rear end 22 to the front end 24. The middle section 20 includes a notch or slot 30. The slot 30 is located proximate the rear end of the sleeve and forms a stop ledge 32. The slot 30 extends entirely through the middle section 20 from the interior surface to the exterior surface. However, in an alternate embodiment, the slot 30 need not extend entirely through the middle section 20. The middle section 20 also has an elongate recess 31 along its interior side. The elongate recess 31 extends from the front of the slot 30 to the front end of the sleeve 12. However, in an alternate embodiment, the recess need not be provided. Other types of shells could also be used.

Figure 2:
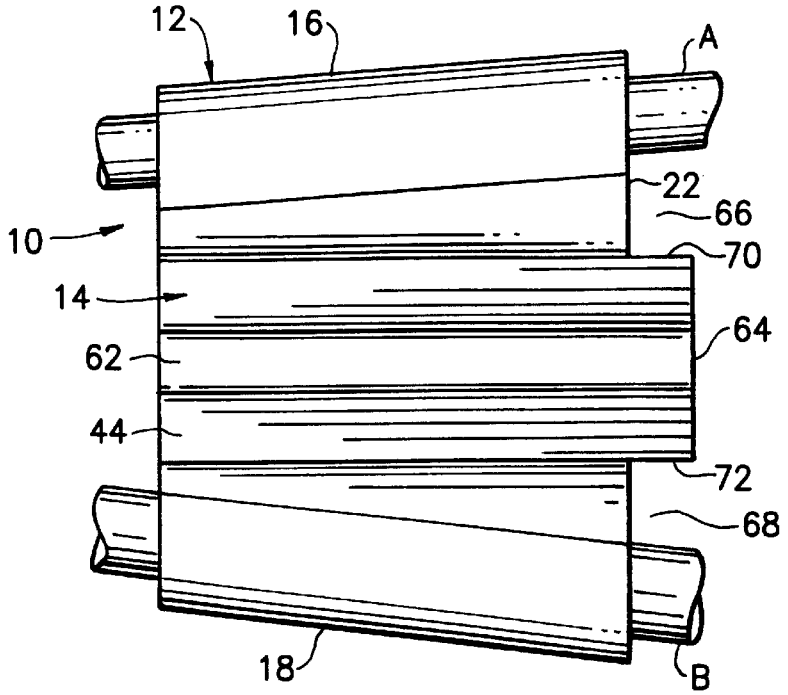
FIG. 2 is a side elevational view of the assembly of the wedge connector and conductors shown in FIG. 1.

Referring also to FIG. 2, the wedge 14 is a one-piece member preferably made of drawn metal. The wedge 14 is suitably sized and shaped to be inserted into the sleeve 12 and wedge the conductors A, B against the sleeve 12 at the interior sides of the channel sections 16, 18. The wedge 14 has a general tubular wedge shape or general cone shape with a substantially hollow interior. The wedge 14 has a conductor contacting surface 34 on a first top side 36, a conductor contacting surface 38 on a second bottom side 40, a third side 42 and a fourth side 44. Both the front end 46 and the rear end 48 are substantially open. The two conductor contacting surfaces 34, 38 have an inward curve to form seats for the conductors A, B. The surfaces 34, 38 are for sandwiching the conductors A, B against the interior side of the sleeve 12.

The third side 42 has a lateral projection 52 for latching with the sleeve 12. The projection 52 has a cross-sectionally curved dome shape and a recessed rear latch surface 56. The projection 52, slot 30 and recess 31 are suitably sized, shaped and positioned such that the rear latch surface 56 extends into the slot 30 when the wedge 14 is fully inserted into the sleeve 12. More specifically, the projection 52 is adapted to deflect the projection 52 over the rear section 60 of the sleeve 12. The latch surface 56 is adapted to engage stop ledge 32 to prevent accidental withdrawal of the wedge 14 from the sleeve 12.

The fourth side 44 has a protruding shape that extends laterally outward between the top and bottom sides 36, 40. The fourth side 44, in the embodiment shown, has a section 62 with a general pyramid profile as seen best in FIGS. 1 and 3. When the wedge 14 is inserted into the sleeve 12, a portion of the pyramid profile can extend out of the sleeve 12 at the open lateral area of the general cross-sectional C-shape at edges 54, 55.

The wedge 14 is preferably made by deep drawing metal into a general cup shaped member. An opening in the bottom of the cup shape member would then be cut out to form the front end 46 and general tubular shape. In an alternate method, a member having a general tube shape could be provided. The member would then be deformed to form a tube shaped wedge with a hollow interior, open front and rear, and the inwardly curved conductor contact surfaces. These methods allow all side walls of the wedge to be integrally continuous with adjacent side walls. The thickness of the side walls is preferably varied, but can be kept at a substantially constant thickness throughout the wedge to enhance predictability. The wedge could also be extruded.

The rear end 48 of the wedge 14 has been provided with a grasping and collapsing section 64. More specifically, in the embodiment sown, the rear end of the pyramid shaped section 62 extends rearward past the rear end of the rest of the wedge 14. When the wedge 14 is fully inserted into the sleeve 12, the rear end 48 of the wedge is located substantially entirely inside the sleeve 12. However, as seen in FIG. 2, the rearward extension 64 extends past the rear end 22 of the sleeve 12.

Figure 3:
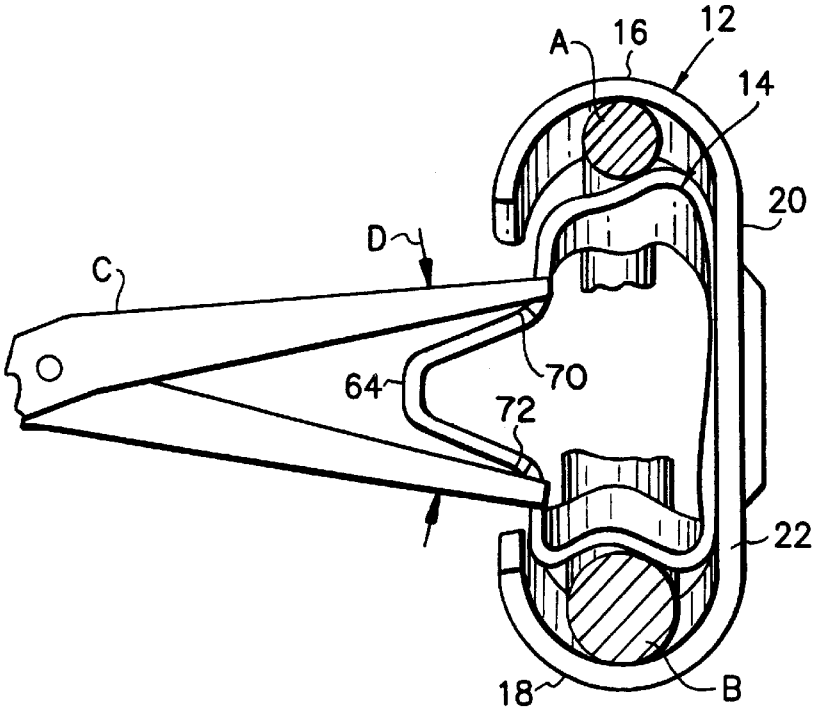
FIG. 3 is a rear end elevational view of the wedge connector and conductors shown in FIG. 2 showing the wedge being collapsed.

Referring also to FIG. 3, the reason the extension 64 is provided is to aid in the removal of the wedge 14 from the sleeve 12. More specifically, the user can use a tool C to grasp onto the extension 64 and compress the extension 64 as indicated by arrows D. Open areas 66, 68 (see FIG. 2) allow the tool C access on a top side 70 and a bottom side 72 of the extension 64. The tool C can compress the two sides 70, 72 towards each other. This partially collapses the rear end of the wedge 14 and allows the user to move the rear latch surface 56 out of latching engagement with the stop ledge 32. The extension also forms a secure grasping surface for the tool during and after collapse. Thus, the wedge 14 can be removed from the sleeve 12.

Figure 4:
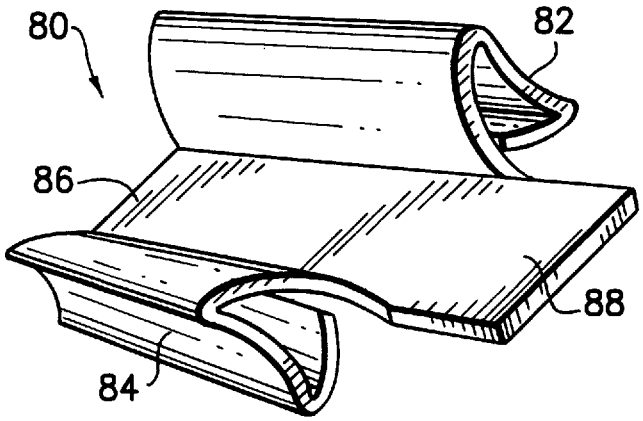
FIG. 4 is a perspective view of an alternate embodiment of the wedge shown in FIG. 1.

Referring to FIG. 4, there is shown a perspective view of an alternate embodiment of a wedge 80 incorporating features of the present invention. The wedge 80 is a one-piece member made of cut and folded sheet metal. The wedge 80 has a top side conductor contacting surface 82, a bottom side conductor contacting surface 84, a connecting middle section 86, and a rear end extension 88. The rear end extension 88 extends past the rear end of the rest of the wedge 80. The rear end extension 88 is not intended to be collapsible, but does form a grasping surface for a user to grasp onto the wedge after it has been inserted into the sleeve to facilitate removal of the wedge from the sleeve.

Figure 5:
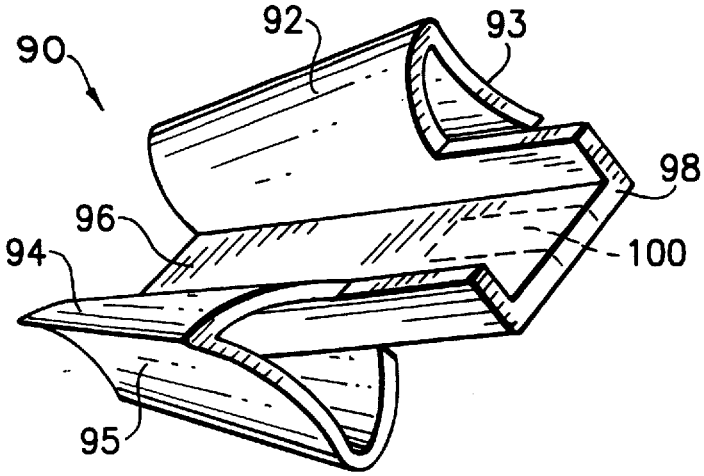
FIG. 5 is a perspective view of another alternate embodiment of the wedge.

Referring to FIG. 5, there is shown a perspective view of another alternate embodiment of a wedge 90 incorporating features of the present invention. The wedge 90 is a one-piece member made of cut and folded sheet metal. The wedge 90 has a top section 92 with a top conductor contact surface 93, a bottom section 94 with a bottom conductor contact surface 95, a middle section 96, and a rear extension 98. In this embodiment, the rear extension 98 extends from the middle section 96 and portions of the top and bottom section 92, 94. The extension 98 could be collapsible, but need not be collapsible. In an alternate embodiment, the rear extension need not be solid. For example, the rear extension could have a cut-out 100 as shown in dotted lines in FIG. 5.

It should be understood that the terms "top" and "bottom" have been used for descriptive purposes only. The sleeve and wedge could be orientated in any suitable position, so long as they can be properly connected to each other. Other shapes of wedges and sleeves could also be used while still practicing the features of the present invention. Other types of means for locking the wedge with the sleeve could also be provided.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a connector sleeve; and a one-piece wedge suitably sized and shaped to be inserted into the sleeve, the wedge being comprised of a thin metal member having a rear end with a rearward extension extending at one lateral side, wherein, when the wedge is fully inserted into the sleeve, the rear end of the wedge is substantially located inside the sleeve and the rearward extension extends past a rear end of the sleeve to provide a grasping surface, wherein the rearward extension has a general pyramid profile.

2. A connector as in claim 1 wherein the wedge has a general tubular shape with two conductor contacting surfaces for sandwiching conductors against an interior side of the sleeve.

3. A connector as in claim 2 wherein the lateral side of the wedge has a general pyramid profile.

4. A connector as in claim 1 wherein an opposite second lateral side of the wedge has a projection for latching with the sleeve.

5. A connector as in claim 4 wherein the projection extends along substantially the entire length of the second lateral side.

6. A connector as in claim 5 wherein the sleeve has a notch and wherein a rear end of the projection latches against a surface in the notch.

7. A connector as in claim 1 wherein the wedge is comprised of an extruded metal member.

8. A connector as in claim 1 wherein the wedge is comprised of a sheet metal member.

9. An electrical wedge connector comprising:

a connector sleeve; and a one-piece wedge suitably sized and shaped to be inserted into the sleeve, the wedge having a general tubular wedge shape with a rear end having a collapsible rearward extension, wherein the extension is adapted to be collapsed to move two conductor contacting surfaces of the wedge towards each other for removing the wedge from the sleeve.

10. A connector as in claim 9 wherein the wedge is comprised of an extruded metal member.

11. A connector as in claim 9 wherein the wedge is comprised of a sheet metal member.

12. A connector as in claim 9 wherein the wedge is comprised of a drawn metal member.

13. A connector as in claim 9 wherein the rearward extension is on a lateral side of the wedge and has a general pyramid profile.

14. A connector as in claim 9 wherein the rearward extension is located on a first lateral side of the wedge and has a general pyramid profile.

15. A connector as in claim 14 wherein an opposite second lateral side of the wedge has a projection for latching with the sleeve.

16. A connector as in claim 15 wherein the projection extends along substantially the entire length of the second lateral side.

17. A connector as in claim 16 wherein the sleeve has a notch and wherein a rear end of the projection latches against a surface in the notch.

18. A connector as in claim 9 wherein the rearward extension has a top section and a bottom section that are moved towards each other to collapse the extension.

19. An electrical wedge connector comprising:

a connector sleeve; and a one-piece wedge suitably sized and shaped to be inserted into the sleeve, the wedge being comprised of a thin metal member having a rear end with a rearward extension extending at one lateral side, wherein, when the wedge is fully inserted into the sleeve, the rear end of the wedge is substantially located inside the sleeve and the rearward extension extends past a rear end of the sleeve to provide a grasping surface, and wherein the wedge has a general tubular shape with two conductor contacting surfaces for sandwiching conductors against an interior side of the sleeve.

* * * * *